US006502932B1

(12) United States Patent
Umemura

(10) Patent No.: US 6,502,932 B1
(45) Date of Patent: Jan. 7, 2003

(54) PRINT HEAD DEVICE AND INK JET PRINTER INCLUDING THE PRINT HEAD DEVICE

(75) Inventor: Shunji Umemura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/609,209

(22) Filed: Jul. 5, 2000

(30) Foreign Application Priority Data

Jul. 7, 1999 (JP) ..... 11-193534

(51) Int. Cl.[7] ..... B41J 2/175
(52) U.S. Cl. ..... 347/86; 347/87
(58) Field of Search ..... 347/85, 86, 87, 347/49; 277/607, 641, 645

(56) References Cited

U.S. PATENT DOCUMENTS

| | | | | |
|---|---|---|---|---|
| 5,633,667 A | * | 5/1997 | Miyazawa | 347/86 |
| 5,790,158 A | * | 8/1998 | Shinada et al. | 347/86 |
| 6,039,441 A | * | 3/2000 | Tomikawa et al. | 347/86 |
| 6,244,698 B1 | * | 6/2001 | Chino et al. | 347/94 |
| 6,264,316 B1 | * | 7/2001 | Chino | 347/86 |
| 6,361,159 B1 | * | 3/2002 | Chino | 347/86 |

FOREIGN PATENT DOCUMENTS

| | | | |
|---|---|---|---|
| JP | 60-141564 | 7/1985 | |
| JP | 4-53752 | 2/1992 | |
| JP | 10-193646 | * 7/1998 | |
| JP | 2000-094711 | 4/2000 | ..... D41J/2/175 |

* cited by examiner

*Primary Examiner*—Michael Nghiem
(74) *Attorney, Agent, or Firm*—Hogan & Hartson, LLP

(57) ABSTRACT

There is provided a print head device which is capable of mounting an ink cartridge therein with a small mounting force without spoiling the sealing performance of a seal packing and minimizing the deformation of a contact portion of the seal packing where the ink cartridge is brought into contact, and an ink jet printer incorporating the print head device. The print head device includes a print head unit, an ink cartridge removably mounted in the print head unit, and a seal packing. The print head unit has an ink jet print head, and an ink reception block for receiving supply of ink. The ink cartridge is removably mounted in said print head unit, and has an ink delivery block for delivering ink therefrom. The seal packing has a generally hollow cylindrical shape and arranged between said ink delivery block of said ink cartridge and said ink reception block of said print head unit. The seal packing has a fitting portion for airtight fit on a peripheral surface of said ink reception block, an intimate contact portion for intimate contact with said ink delivery block, and an intermediate hollow cylindrical portion continuous between said fitting portion and said intimate contact portion, and formed to be smaller in thickness than said fitting portion and said intimate contact portion.

8 Claims, 6 Drawing Sheets

PRINT HEAD DEVICE AND INK JET PRINTER INCLUDING THE PRINT HEAD DEVICE

BACKGROUND OF THE INVENTION

1. Field of the Invention

This invention relates to a print head device which includes a print head unit carrying a print head thereon, and an ink cartridge mounted in the print head unit, and an ink jet printer incorporating the print head unit, more particularly an ink jet printer of this kind which uses a tape as a medium to be printed upon.

2. Prior Art

Conventionally, an ink jet printer of this kind includes a type in which an ink delivery port of an ink cartridge is tightly connected to a connecting cap (connecting member) of a print head unit thereof in surface-to-surface contact. In the ink jet printer of this type, a seal packing is interposed between the connecting cap and the ink delivery port such that the seal packing is fitted on the connecting cap, for preventing evaporation of a solvent contained in ink. When an ink cartridge is mounted in the print head unit, a distal end portion on an ink cartridge-side of the seal packing is deformed by. compression such that the distal end is expanded, and brought into annular intimate contact with a rim of the ink delivery port. This makes it possible to prevent vaporization of water content of the ink and leakage of the ink itself from the ink cartridge mounted in the print head unit.

In the conventional seal packing of the above-mentioned kind, the distal end portion of the seal packing is compressed and deformed such that the distal end is expanded, by the force applied in the mounting of the ink cartridge. However, if the distal end portion of the seal packing is brought into nonuniform surface-to-surface abutment with the rim of the ink delivery port, the distal end portion is deformed not into a proper annular shape but into a distorted annular shape, in plan view. In such a case, there is a fear that a gap is produced between the distal end portion of the seal packing and the rim of the ink delivery port. Further, in an ink cartridge containing a plurality of colors of inks for color printing, deformed distal end portions of seal packings for the respective ink delivery ports can be brought into contact with each other, thereby causing mixture of inks of different colors.

Further, the urging force of the ink cartridge required for deforming the seal packing by compression is increased in proportion to the amount of the deformation, so that when an ink cartridge for use in color printing is mounted, a very large urging force is required to simultaneously deform a plurality of seal packings, which can undesirably deform a supporting member, such as a carriage bar or the like, at which the urging force is finally received or withstood.

SUMMARY OF THE INVENTION

It is a first object of the invention to provide a print head device in which an ink cartridge can be mounted with a small mounting force without spoiling the sealing performance of a seal packing and minimizing the deformation of a contact portion of the seal packing where the ink cartridge is brought into contact.

It is a second object of the invention to provide an ink jet printer including a print head device in which an ink cartridge can be mounted with a small mounting force without spoiling the sealing performance of a seal packing and minimizing the deformation of a contact portion of the seal packing where the ink cartridge is brought into contact.

To attain the first object, according to a first aspect of the invention, there is provided a print head device comprising:

a print head unit, the print head unit having an ink jet print head, and an ink reception block for receiving supply of ink;

an ink cartridge, the ink cartridge being removably mounted in the print head unit, and having an ink delivery block for delivering ink therefrom; and a seal packing having a generally hollow cylindrical shape and arranged between the ink delivery block of the ink cartridge and the ink reception block of the print head unit, the seal packing having:

- a fitting portion for airtight fit on a peripheral surface of the ink reception block;
- an intimate contact portion for intimate contact with the ink delivery block; and
- an intermediate hollow cylindrical portion continuous between the fitting portion and the intimate contact portion, and formed to be smaller in thickness than the fitting portion and the intimate contact portion.

According to this print head, the intermediate hollow cylindrical portion is formed to be smaller in thickness than the fitting portion and the contact portion, so that when an urging force acts axially on the seal packing in accordance with the mounting of the ink cartridge, the intermediate hollow cylindrical portion is preferentially deformed by compression. The deformation of the intermediate hollow cylindrical portion is controlled by the fitting portion and the contact portion. That is, the fitting portion and the contact portion are formed at opposite axial ends of the seal packing such that they have an increased thickness, and hence a stress responsive to the urging force applied to the seal packing is concentrated on the intermediate hollow cylindrical portion, which is expanded outwardly to be deformed such that the intermediate hollow cylindrical portion has an outwardly expanding arcuate profile in radial cross-section. Consequently, not only the fitting portion but also the intimate contact portion brought into intimate contact with the ink delivery block of the ink cartridge is prevented from being expanded and deformed before and after the ink cartridge is mounted. This also prevents the compression or contraction of the seal packing from causing displacement of the intimate contact portion from its proper contact position. Therefore, it is possible to enhance the sealing performance of the seal packing and component parts associated therewith as well as effectively prevent colors of inks from being undesirably mixed. Further, when the intermediate hollow cylindrical portion is deformed such that it has an outwardly expanding arcuate profile in radial cross-section, the direction of the urging force and that of the deformation are orthogonal to each other, so that the rate of increase in the stress (spring force) responsive to the urging force is progressively decreased with respect to the pressing stroke of the ink cartridge. Therefore, the mounting force required for mounting the ink cartridge can be held at a low level.

Preferably, the ink reception block has a peripheral surface formed with an annular groove, and the fitting portion has an inner peripheral surface formed with an annular projection for being fitted in the annular groove.

According to this preferred embodiment, the annular projection of the seal packing is fitted in the annular groove of the ink reception block, whereby the seal packing is immovably held, and the annular projection is brought into intimate contact with the annular groove such that the annular projection air tightly narrows the annular groove. This makes it possible to enhance the sealing performance of the fitting portion of the seal packing.

Preferably, the annular groove is arcuate in radial cross-sectional profile, and the annular projection has a shape arcuate in radial cross-sectional profile and complementary to the annular groove.

According to this preferred embodiment, the annular projection and the annular groove are in intimate contact with each other in a large contact area, thereby making it possible to further increase the sealing performance of the fitting portion of the seal packing.

Preferably, the seal packing has an inner peripheral surface which is axially flush and extends from the intermediate hollow cylindrical portion to the intimate contact portion, and the seal packing has an outer peripheral surface which is axially flush and extends from the intermediate hollow cylindrical portion to the fitting portion.

According to this preferred embodiment, when the seal packing is formed as a unitary member, it can be molded with ease by using an upper mold and a lower mold formed in view of die cutting.

Preferably, the intimate contact portion has an engagement portion for engagement with the ink cartridge, the engagement portion being arcuate in radial cross-sectional profile.

According to this preferred embodiment, the intimate contact portion can be in stable contact with the ink delivery block, thereby enhancing the sealing performance of the intimate contact portion of the seal packing.

Preferably, the ink cartridge is formed with a groove for engagement with at least one portion of the intimate contact portion.

According to this preferred embodiment, a contact position at which the intimate contact portion of the seal packing is brought into intimate contact with the ink delivery block can be prevented from being displaced when the ink cartridge is mounted.

More preferably, the at least one portion of the intimate contact portion is an engagement portion for engagement with the groove, the engagement portion being arcuate in radial cross-sectional profile.

To attain the second object, according to a second aspect of the invention, there is provided an ink jet printer including a print head device, the print head device comprising:

- a print head unit, the print head unit having an ink jet print head, and an ink reception block for receiving supply of ink;
- an ink cartridge, the ink cartridge being removably mounted in the print head unit, and having an ink delivery block for delivering the ink therefrom; and
- a seal packing having a generally hollow cylindrical shape and arranged between the ink delivery block of the ink cartridge and the ink reception block of the print head unit,
- the seal packing having:
  - a fitting portion for airtight fit on a peripheral surface of the ink reception block;
  - an intimate contact portion for intimate contact with the ink delivery block; and
  - an intermediate hollow cylindrical portion continuous between the fitting portion and the intimate contact portion, and formed to be smaller in thickness than the fitting portion and the intimate contact portion.

According to this ink jet printer, the ink cartridge can be mounted with a relatively small force without spoiling the sealing performance of the seal packing. Further, it is possible to effectively prevent mixture of color inks caused by mounting and removal of the ink cartridge and leakage of air from the seal packing. That is, it is possible to construct a user-friendly ink jet printer which is improved in reliability.

Preferably, the ink jet printer includes a tape cartridge containing a printing tape on which printing is carried out by the print head device, the tape cartridge being removably mounted in the ink jet printer.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. In the embodiment, a print head device and an ink jet printer according to the invention are applied to a tape printing apparatus. The tape printing apparatus is capable of carrying out color printing of desired characters, etc. entered by keyboard, on a tape as a medium to be printed upon, by an ink jet printing method, and cutting off the printed portion or strip of the tape to thereby produce a label.

Figure 1:
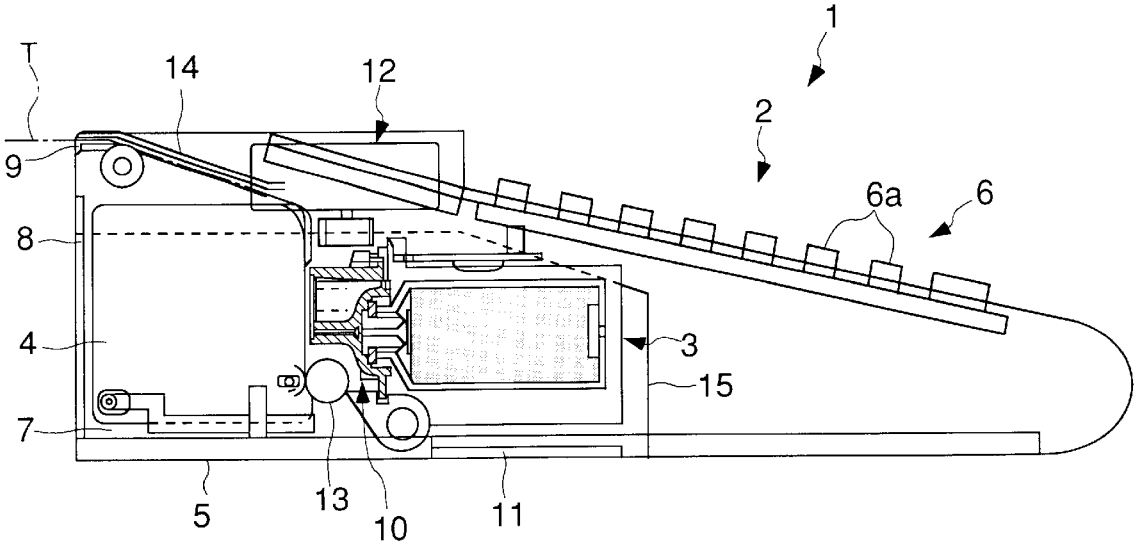
FIG. 1 is a cross-sectional view of a tape printing apparatus to which a print head device and an ink jet printer according an embodiment of the invention are applied.

Referring first to FIG. 1, there is shown the tape printing apparatus with the ink cartridge and a tape cartridge mounted therein. As shown in the figure, the tape printing apparatus 1 is comprised of the ink cartridge 3 filled with a plurality of colors of inks, the tape cartridge 4 containing a tape T, and a main unit 2 in which the ink cartridge 3 and the tape cartridge 4 are removably mounted. The main unit 2 has an apparatus casing 5 having a keyboard 6, which includes various kinds of keys 6*a,* etc., arranged on a front portion thereof, and a liquid crystal display, not shown, arranged on a rear portion thereof.

In a rear wall of the apparatus casing 5, there is formed a first lid 8 in a manner facing a tape cartridge compartment 7 for loading i.e. mounting the tape cartridge 4 therein. The first lid 8 can be opened and closed for mounting and removing the tape cartridge 4. Further, the rear wall of the apparatus casing 5 has a tape exit 9 in the form of a slit formed at a location above the first lid 8, for discharging a printed portion of the tape T out of the apparatus casing 5. A second lid 11 which can be opened and closed for mounting and removing the ink cartridge 3 is arranged in a bottom wall of the apparatus casing 5 at a location opposed to a print head unit 10, described hereinafter.

Within the apparatus casing 5, there is arranged an information processing section (not shown) in a front region. The print head unit 10 on which the ink cartridge 3 is mounted and a head-driving block 12 for causing the print head unit 10 to move (scan) during printing are arranged in a central region within the apparatus casing 5, and a tape-feeding block 13 for feeding the tape T from the tape cartridge 4, a tape-discharging block 14 for discharging a printed portion of the tape, etc. are arranged in a rear region within the same. The print head unit 10, the head-driving block 12, and the tape-feeding block 13 are supported on a base frame 15 and incorporated in the main unit 2.

After an image to be printed is finally determined on the liquid crystal display by operating keys 6*a,* if a print command is issued, the tape-feeding block 13 operates to roll out the tape T from the tape cartridge 4. After having been rolled out from the tape cartridge 4, the tape T passes in front of the print head unit 10. Then, the tape T is properly cut by the tape-discharging block 14, followed by being discharged from the apparatus casing 5. In accordance with the running of the tape T in front of the print head unit 10, the print head unit 10 is driven by the head-driving block 12 to perform lateral reciprocating motion repeatedly while jetting or ejecting inks supplied from the ink cartridge 3, to thereby carry out printing on the tape T. More specifically, the desired image is printed on the tape T with the direction of reciprocation of the print head unit 10 set as a main scanning direction and the direction of feed of the tape T set as a sub scanning direction.

Figure 2:
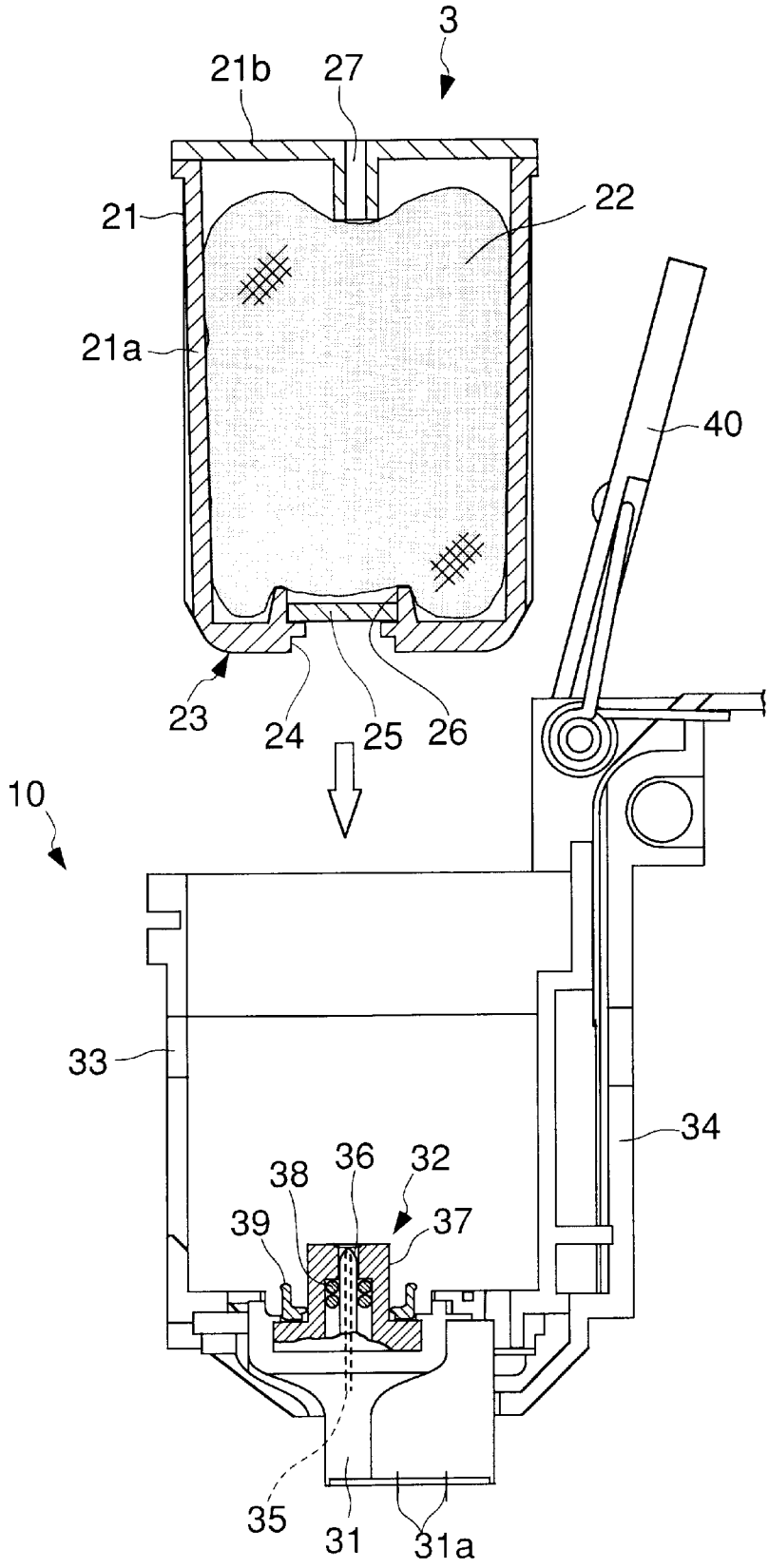
FIG. 2 is a cross-sectional view of an ink cartridge and a print head unit of the print head device according the embodiment.

Next, description will be made of the print head unit 10 and the ink cartridge 3 with reference to FIG. 2. As shown in the figure, the ink cartridge 3 has a cartridge case 21 comprised of a lower casing 21*a* and an upper casing 21*b* arranged in a manner closing an open upper end of the lower casing 21*a.* The cartridge case 21 is a so-called ink reservoir filled with ink absorbent materials 22 for holding inks in a state absorbed therein. The ink reservoir is divided into four separate containers, not shown, for containing cyan, magenta, yellow, and black inks, respectively.

The lower casing 21*a* has a bottom formed with an ink delivery block 23, and the print head unit 10 includes an ink reception block 32 corresponding to the ink delivery block 23. When the ink cartridge 3 is mounted in the print head unit 10, the ink delivery block 23 is connected to the ink reception block 32, which makes it possible to deliver each ink from the ink cartridge 3 to the print head unit 10.

The ink delivery block 23 is formed with four ink delivery ports 24 for delivering the inks of four colors, respectively. The ink cartridge 3 is tightly connected to the ink reception block 32 of the print head unit 10 in surface-to-surface contact (or removed from the same) via the respective ink delivery ports 24. A filter 25 is arranged at a location inward of each ink delivery port 24 and downstream of the ink absorbent material 22 such that the filter 25 extends over an inner open end of the ink delivery port 24. The filter 25 is slidably attached to a filter-accommodating block 26 formed inward of the ink delivery port 24. The ink stored in the ink absorbent material 22 is supplied to the print head unit 10 through the filter 25.

The upper casing 21*b* is formed with four ink-charging ports (air inlet ports) 27 corresponding to the respective four ink delivery ports 24. The ink-charging ports 27 are made open to the atmosphere via respective meandering passages, not shown, formed in the top surface of the upper casing 21*b*. As the inks within the ink cartridge 3 are supplied to the print head unit 10, air is drawn in through each of the meandering passages by an amount corresponding a volume of a corresponding ink supplied to the print head unit 10, and introduced into a corresponding container of the ink cartridge 3 via the meandering passage.

The print head unit 10 is comprised of a print head 31 having a large number of nozzles 31*a* arranged in an end thereof in a state aligned with each other, the ink reception block 32 communicating with the print head 31, and a cartridge holder 33 in the form of a case, whose bottom defines the ink reception block 32 therein. The print head unit 10 is installed on a carriage 34 connected to the head-driving block 12. The ink reception block 32 is comprised of four head needles 36 each of which is formed with an ink supply passage 35 extending therethrough and communicating with the print head 31, four connecting caps (connecting members) 37 having the respective head needles 36 inserted therein such that each cap covers or surrounds corresponding one of the head needles 36, and two O rings 38, 38 interposed between the head needle 36 and the connecting cap 37 for providing a seal therebetween. Further, each connecting cap 37 has a seal packing 39 fitted thereon for controlling evaporation of the ink such that the seal packing 39 surrounds an intermediate part of a protruding portion of the connecting cap 37.

Figure 3:
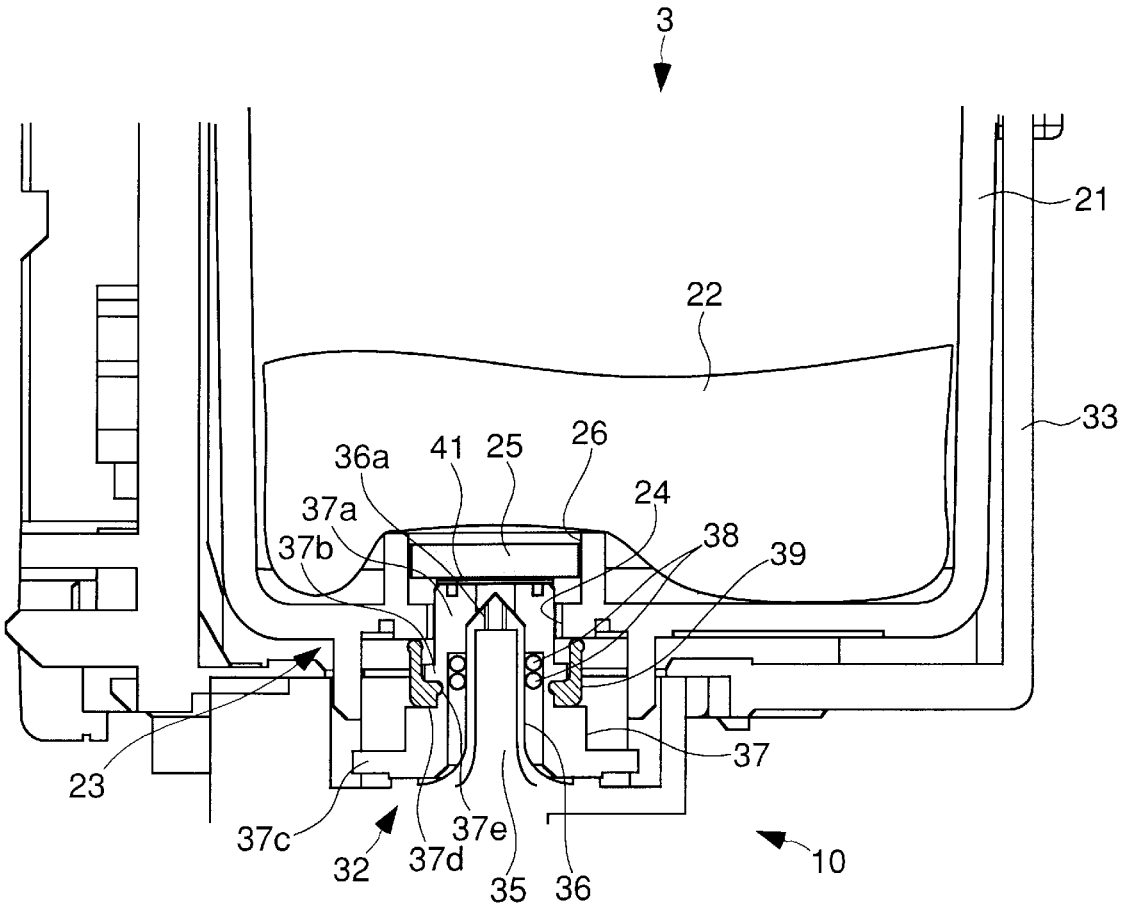
FIG. 3 is an enlarged partial cross-sectional view of the print head unit with the ink cartridge inserted therein.
Figure 4:
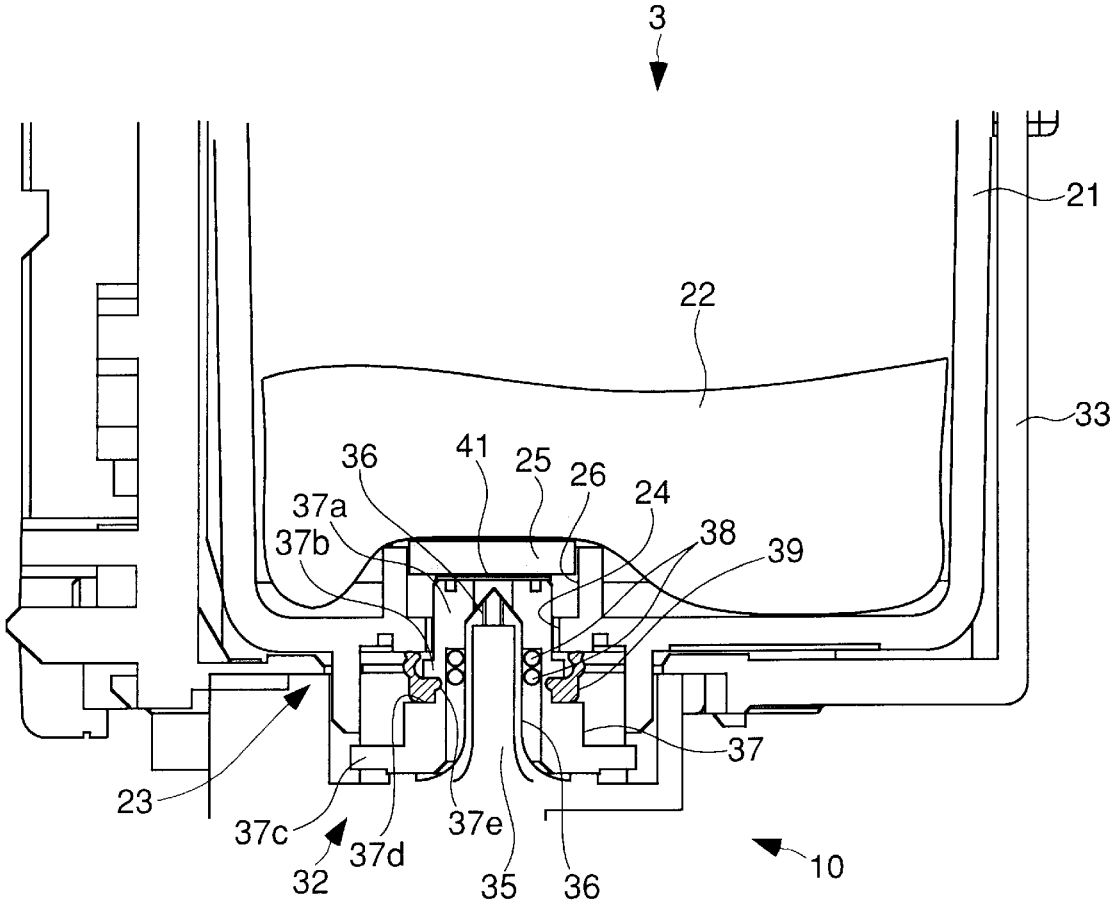
FIG. 4 is an enlarged partial cross-sectional view of the print head unit with the ink cartridge mounted (completely mounted) therein.

When the ink cartridge 3 is mounted in the print head unit (cartridge holder 33) 10, the ink delivery port 24 and the connecting cap 37 are joined to each other, while the seal packing 39 is brought into contact with a rim of the ink delivery port 24, and at the same time the end of the connecting cap 37 abuts the filter 24 in a manner pushing the same upward (see FIGS. 3, 4). It should be noted that reference numeral 40 in FIG. 2 indicates an urging lid for urging the ink cartridge 3 inserted in the cartridge holder 33 toward the print head 31. By inserting the ink cartridge 3 in the cartridge holder 33, and locking the urging lid 40 in a closed state, the ink cartridge 3 is suitably (completely) mounted on the print head unit 10.

As shown on enlarged scale in FIGS. 3 and 4, the head needle 36 having a steeple-like needlepoint and a flanged root end is formed with an ink supply passage 35 extending therethrough and communicating with the nozzles 31*a* on the print head 31. The tip of the head needle 36 is formed with a plurality of small holes 36*a,* via which the inside of the ink cartridge 3 and the ink supply passage 35 are in communication with each other. The connecting caps 37 are each comprised of a cap body 37*a* in which the needlepoint of the head needle 36 extends, a packing-holding portion 37*b* continuous with the cap body 37*a* and having the seal packing 39 fitted thereon, and a flange portion 37*c* continuous with the packing-holding portion 37*b,* all of which are integrally formed as a unitary member. Further, reference numeral 41 in the figures designates a print head unit-side filter attached to the end of the connecting cap 37.

Figure 5A:
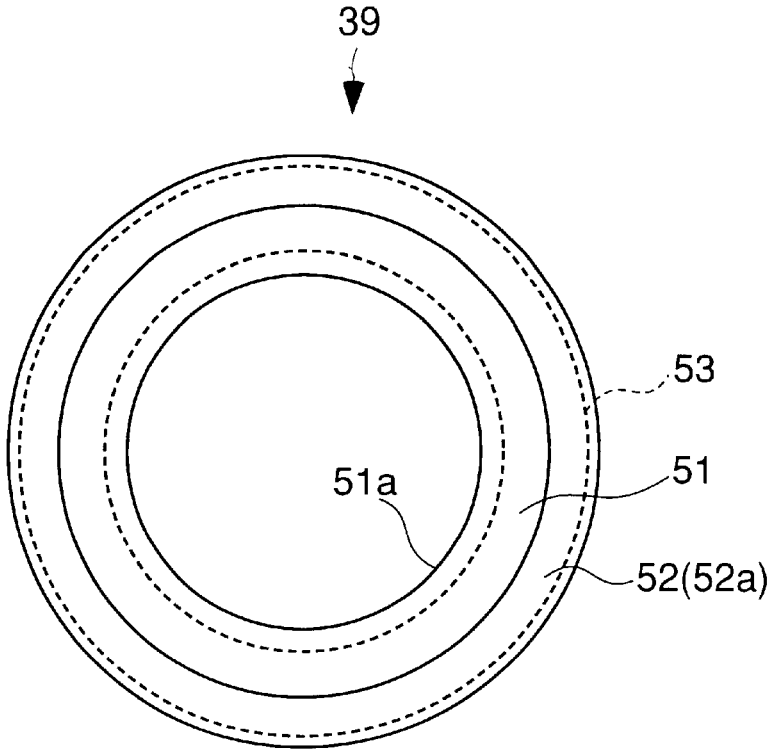
FIG. 5A is a plan view showing the construction of a seal packing.
Figure 5B:
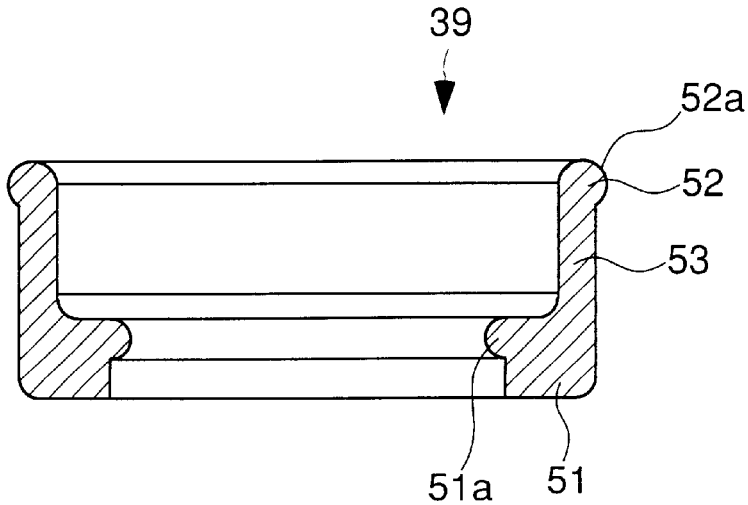
FIG. 5B is a side view showing the construction of the seal packing.

The seal packings 39 are each formed of butyl rubber, silicone rubber or the like such that it has a generally hollow cylindrical shape. As shown in FIGS. 3, 5A, and 5B, the seal packing 39 is comprised of a fitting portion 51 for airtight fit on a peripheral surface of the connecting cap 37, an intimate contact portion 52 for being brought into intimate contact with the rim of the ink delivery port 24 of the mounted ink cartridge 3, and an intermediate hollow cylindrical portion 53 extending between the fitting portion 51 and the intimate contact portion 52, all of which are integrally formed as a unitary member.

The fitting portion 51 is formed to have a large radial thickness such that it extends inwardly, and an inner peripheral surface thereof is formed with an annular projection 51*a* having an arcuate cross-sectional profile. On the other hand, the packing-holding portion 37*b* of the connecting cap 37 corresponding to the fitting portion 51 is formed with an annular concave portion 37*d* for having the fitting portion 51 fit therein, and on a rear or distal side portion of the annular concave portion 37*d* is formed an annular groove 37*e* having an arcuate cross-sectional profile and corresponding to the above annular projection 51*a*. When the seal packing 39 is mounted in the connecting cap 37, the fitting portion 51 of the seal packing 39 is fitted in the annular concave portion 37*d* of the packing-holding portion 37*b* such that fitting portion. 51 is seated or rests on the annular concave portion 37*d*. The annular projection 51*a* and the annular groove 37*e* are formed to have respective shapes complementary to each other, and when the fitting portion 51 is fitted in the annular concave portion 37*d*, the annular projection 51*a* and the annular groove 37*e* are in intimate contact with each other. As described above, since the seal packing 39 is fitted on the connecting cap 37, it is possible to enhance shock resistance of the print head device.

The intermediate hollow cylindrical portion 53 has a hollow cylindrical shape relatively small in radial thickness. Further, the intimate contact portion 52 is in direct and intimate contact with the rim of the ink delivery port 24, and has a contact part 52*a* slightly offset outwardly therefrom to have an arcuate cross-sectional profile. This makes it possible to form the seal packing 39 such that the intermediate hollow cylindrical portion 53 has an inner peripheral surface in flush with an inner peripheral surface of the intimate contact portion 52, and at the same time has an outer peripheral surface in flush with an outer peripheral surface of the fitting portion 51. In otherwords, the seal packing 39 has an inner peripheral surface which is axially flush and extends from the intermediate hollow cylindrical portion 53 to the intimate contact portion 52, and an outer peripheral surface which is axially flush and extends from the intermediate hollow cylindrical portion 53 to the fitting portion 51. This enables the seal packing 39 to be formed as a unitary member with ease by using an upper mold and a lower mold. The portions of the seal packing 39 formed as above have a smaller radial thickness in the order of the fitting portion 51, the intimate contact portion 52, and the intermediate hollow cylindrical portion 53.

FIG. 3 shows the ink cartridge 3 inserted in the cartridge holder 33. The rim of the ink delivery port 24 of the ink cartridge 3 abuts the fitting portion 52 of the seal packing 39 mounted in the connecting cap 37 such that the ink cartridge 3 is slightly lifted. When the above-mentioned urging lid 40 is closed from this sate, the ink cartridge 3 is moved toward the seal packing 39, whereby the intermediate hollow cylindrical portion 53 is compressed and deformed such that the cylindrical portion 53 is crushed (see FIG. 4). As described above, the intermediate hollow cylindrical portion 53 is made smaller in thickness than the fitting portion 51 and the intimate contact portion 52. Consequently, when the ink cartridge 3 is pressed, a stress is concentrated on the intermediate hollow cylindrical portion 53 of the seal packing 39, and the intermediate hollow cylindrical portion 53 is expanded outwardly with a mid portion thereof as a center and thereby deformed such that it has an outwardly expanding arcuate profile in radial cross-section.

Figure 6:
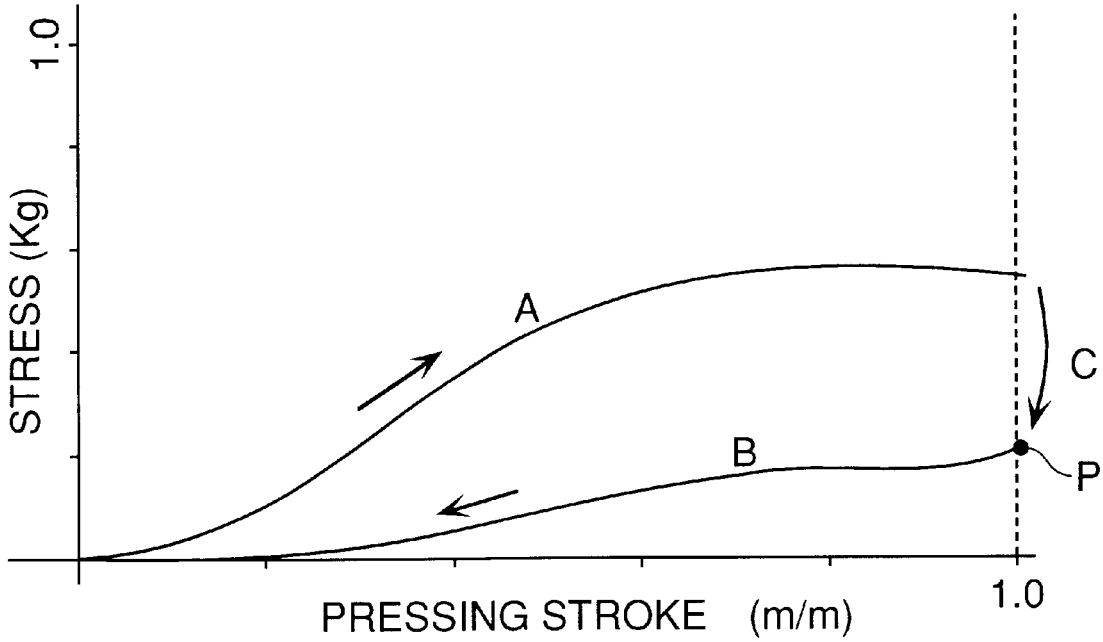
FIG. 6 is a diagrammatic view showing the relationship between the pressing stroke of the ink cartridge and the stress of the seal packing corresponding to the pressing stroke, which is useful in explaining the characteristic of the seal packing compressed and the stress and distortion thereof.

FIG. 6 is a diagrammatic view showing the relationship between the pressing stroke of the ink cartridge 3 and the stress of the seal packing (single seal packing) 39 corresponding to the pressing stroke. An upper curved line A represents a state in which the intermediate hollow cylindrical portion 53 of the seal packing 39 is compressed, while a lower curved line B represents a state in which the cylindrical portion 53 is extended. Even after hysteresis C of the seal packing 39 is taken into account, a desired stress acts on the ink cartridge 3 when the ink cartridge 3 is properly mounted on the print head unit 10, so that the seal packing 39 is brought into airtight contact with the ink cartridge 3 and the print head unit 10. Further, a stress (curved line A) caused by mounting of the ink cartridge 3 exhibits a sine curve-like characteristic such that the rate of increase in the stress of the seal packing 39 becomes dull as the pressing stroke of the ink cartridge 3 becomes long. That is, even when the pressing stroke is made long or short depending on an manufacturing error of the ink cartridge 3, the urging force required for mounting the ink cartridge 3 can be made substantially constant, and at the same time the urging force itself can be held at a low level. It should be noted that the seal packing 39 used for the test concerning the stress of a seal packing is formed of butyl rubber having an outer diameter of 7.4 mm, an inner diameter of 4.5 mm, and a hardness of 50±5 degrees (Hs).

As described above, since the seal packing 39 fitted on each connecting cap 37 is configured such that it has the intermediate hollow cylindrical portion 53 formed smaller in thickness than the fitting portion 51 and the intimate contact portion 52, and compressed to be deformed such that it has an outwardly expanding arcuate profile in radial cross-section, the urging force required for mounting the ink cartridge 3 can be held at a low level without spoiling the sealing performance of the seal packing 39. Accordingly, the urging force of the ink cartridge 3 for compressing and deforming a total of four seal packings can be relatively reduced, thereby preventing an excessively large load from being applied to the carriage 34 supporting the print head unit 10 thereon.

Further, the intimate contact portion 52, formed to be larger in radial thickness than the intermediate hollow cylindrical portion 53, is prevented from being expanded although it is slightly crushed by the ink cartridge 3 inserted. In other words, even when the ink cartridge 3 is pressed for insertion, the contact part 52*a* of the intimate contact portion 52 cannot be displaced with respect to the ink cartridge 3. Therefore, even if the ink cartridge 3 is not brought into uniform surface-to-surface abutment with the intimate contact portion 52, a gap is hardly formed between the intimate contact portion 52 and the ink cartridge 3, and at the same time contact between the intimate contact portion 52 and an adjacent intimate contact portion 52 is prevented, thereby preventing inks from being undesirably mixed. It should be noted that in order to reliably prevent the displacement of the intimate contact portion 52, an annular groove, not shown, for engagement with the intimate contact portion 52 may be formed in the ink cartridge 3.

Although in the present embodiment, a case where the print head device according to the invention is applied to a tape printing apparatus, this is not limitative, but it goes without saying that the print head device constructed as above can be applied to an ink jet printer of the general type.

It is further understood by those skilled in the art that the foregoing are preferred embodiments of the invention, and that various changes and modifications may be made without departing from the spirit and scope thereof.

What is claimed is:

1. A print head device comprising:

a print head unit, said print head unit having an ink jet print head, and an ink reception block for receiving supply of ink;

an ink cartridge, said ink cartridge being removably mounted in said print head unit, and having an ink delivery block for delivering ink therefrom; and a seal packing having a generally hollow cylindrical shape and arranged between said ink delivery block of said ink cartridge and said ink reception block of said print head unit, said seal packing having:

a fitting portion for airtight fit on a peripheral surface of said ink reception block;

an intimate contact portion for intimate contact with said ink delivery block; and an intermediate hollow cylindrical portion continuous between said fitting portion and said intimate contact portion, and formed to be smaller in thickness than said fitting portion and said intimate contact portion;

wherein said ink reception block has a peripheral surface formed with an annular groove, and wherein said fitting portion has an inner peripheral surface formed with an annular projection for being fitted in said annular groove.

2. A print head device according to claim 1, wherein said annular groove is arcuate in radial cross-sectional profile, and said annular projection has a shape arcuate in radial cross-sectional profile and complementary to said annular groove.

3. A print head device according to claim 1, wherein said seal packing has a inner peripheral surface which is axially flush and extends from said intermediate hollow cylindrical portion to said intimate contact portion, and wherein said seal packing has an outer peripheral surface which is axially flush and extends from said intermediate hollow cylindrical portion to said fitting portion.

4. A print head device comprising:

a print head unit, said print head unit having an ink jet print head, and an ink reception block for receiving supply of ink;

an ink cartridge, said ink cartridge being removably mounted in said print head unit, and having an ink delivery block for delivering ink therefrom; and a seal packing having a generally hollow cylindrical shape and arranged between said ink delivery block of said ink cartridge and said ink reception block of said print head unit, said seal packing having:

a fitting portion for airtight fit on a peripheral surface of said ink reception block;

an intimate contact portion for intimate contact with said ink delivery block; and an intermediate hollow cylindrical portion continuous between said fitting portion and said intimate contact portion, and formed to be smaller in thickness than said fitting portion and said intimate contact portion;

wherein said ink reception block has a peripheral surface formed with an annular groove, and wherein said fitting portion has an inner peripheral surface formed with an annular projection for being fitted in said annular groove; and wherein said intimate contact portion has an engagement portion for engagement with said ink cartridge, said engagement portion being arcuate in radial cross-sectional profile.

5. A print head device comprising:

a print head unit, said print head unit having an ink jet print head, and an ink reception block for receiving supply of ink;

an ink cartridge, said ink cartridge being removably mounted in said print head unit, and having an ink delivery block for delivering ink therefrom; and a seal packing having a generally hollow cylindrical shape and arranged between said ink delivery block of said ink cartridge and said ink reception block of said print head unit, said seal packing having:

a fitting portion for airtight fit on a peripheral surface of said ink reception block;

an intimate contact portion for intimate contact with said ink delivery block; and an intermediate hollow cylindrical portion continuous between said fitting portion and said intimate contact portion, and formed to be smaller in thickness than said fitting portion and said intimate contact portion;

wherein said ink cartridge is formed with a groove for engagement with at least one portion of said intimate contact portion.

6. A print head device according to claim 5, wherein said at least one portion of said intimate contact portion is an engagement portion for engagement with said groove, said engagement portion being arcuate in radial cross-sectional profile.

7. An ink jet printer including a print head device, the print head device comprising:

a print head unit, said print head unit having an ink jet print head, and an ink reception block for receiving supply of ink and having a peripheral surface formed with an annular groove;

an ink cartridge, said ink cartridge being removably mounted in said print head unit, and having an ink delivery block for delivering said ink therefrom; and a seal packing having a generally hollow cylindrical shape and arranged between said ink delivery block of said ink cartridge and said ink reception block of said print head unit, said seal packing having:

a fitting portion for airtight fit on a peripheral surface of said ink reception block and having an inner peripheral surface formed with an annular projection for being fitted in said annular groove;

an intimate contact portion for intimate contact with said ink delivery block; and an intermediate hollow cylindrical portion continuous between said fitting portion and said intimate contact portion, and formed to be smaller in thickness than said fitting portion and said intimate contact portion.

8. An ink jet printer according to claim 7, including a tape cartridge containing a printing tape on which printing is carried out by said print head device, said tape cartridge being removably mounted in said ink jet printer.

* * * * *